US011802487B1

(12) United States Patent
Burdette

(10) Patent No.: US 11,802,487 B1
(45) Date of Patent: Oct. 31, 2023

(54) GAS TURBINE ENGINE STATOR VANE FORMED OF CERAMIC MATRIX COMPOSITES AND HAVING ATTACHMENT FLANGES

(71) Applicant: Raytheon Technologies Corporation, Farmington, CT (US)

(72) Inventor: Alyson T. Burdette, Gilbertsville, PA (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/887,782

(22) Filed: Aug. 15, 2022

(51) Int. Cl.
*F01D 9/04* (2006.01)
*F01D 25/00* (2006.01)

(52) U.S. Cl.
CPC ..... *F01D 9/042* (2013.01); *F01D 9/041* (2013.01); *F01D 25/005* (2013.01); *F05D 2220/32* (2013.01); *F05D 2240/12* (2013.01); *F05D 2300/6033* (2013.01)

(58) Field of Classification Search
CPC ..... F01D 9/042; F01D 9/041; F01D 25/005; F01D 5/282; F01D 9/04; F01D 25/246; F05D 2220/32; F05D 2240/12; F05D 2300/6033; F05D 2240/80
See application file for complete search history.

(56) References Cited

U.S. PATENT DOCUMENTS

| | | | | |
|---|---|---|---|---|
| 7,648,336 | B2 * | 1/2010 | Cairo | F01D 9/042 29/889.21 |
| 7,922,444 | B2 * | 4/2011 | Propheter-Hinckley | F01D 11/005 415/110 |
| 8,206,096 | B2 | 6/2012 | Prentice et al. | |
| 9,708,918 | B2 * | 7/2017 | Fremont | F01D 9/065 |
| 10,072,516 | B2 * | 9/2018 | Carr | F01D 9/041 |
| 10,443,625 | B2 | 10/2019 | Langenbrunner et al. | |
| 10,815,801 | B2 | 10/2020 | Watanabe | |
| 11,346,228 | B1 | 5/2022 | Burdette et al. | |
| 2003/0206799 | A1 * | 11/2003 | Scott | F04D 29/542 415/209.3 |
| 2007/0258811 | A1 * | 11/2007 | Shi | F01D 5/282 415/210.1 |
| 2009/0110546 | A1 * | 4/2009 | Tholen | F01D 11/08 415/173.1 |
| 2014/0271153 | A1 * | 9/2014 | Uskert | F01D 5/187 415/177 |

(Continued)

*Primary Examiner* — Eldon T Brockman
*Assistant Examiner* — Andrew Thanh Bui
(74) *Attorney, Agent, or Firm* — Carlson, Gaskey & Olds, P.C.

(57) ABSTRACT

A stator vane formed of CMC has a radially outer platform and a radially inner platform attached to an airfoil. There are a pair of flanges on a side of each of the radially inner platform and radially outer platform which is remote from the airfoil. A first of the pair of flanges is associated with the suction side of the airfoil and a second of the pair of flanges is associated with the pressure side of the airfoil. The flanges extend in a generally axial direction. The first of the pair of flanges extend over at least a majority of the suction side measured between the leading and trailing edge of the airfoil and the second of the pair of flanges extend over at least a majority of the pressure side measured between the leading and trailing edges of the airfoil.

20 Claims, 3 Drawing Sheets

(56) References Cited

U.S. PATENT DOCUMENTS

| | | | | |
|---|---|---|---|---|
| 2015/0040396 | A1* | 2/2015 | Fremont | B29D 99/0025 29/889.71 |
| 2017/0370240 | A1* | 12/2017 | Sippel | F01D 5/225 |
| 2021/0102469 | A1* | 4/2021 | Sobanski | F01D 5/282 |

* cited by examiner

GAS TURBINE ENGINE STATOR VANE FORMED OF CERAMIC MATRIX COMPOSITES AND HAVING ATTACHMENT FLANGES

BACKGROUND OF THE INVENTION

This application related to a stator vane formed of ceramic matrix composites ("CMC") wherein attachment flanges are formed to facilitate mounting of the stator vane.

Gas turbine engines are known, and typically include a fan delivering air into a bypass duct as propulsion air. The fan also delivers air into a compressor where it is compressed. The compressed air passes into a combustor where it is mixed with fuel and ignited. Products of this combustion pass downstream over turbine rotors, driving them to rotate.

It is known that the products of combustion are quite hot, and thus the components in the turbine section are exposed to very high temperatures. Various techniques are used to maintain the operability of those turbine section components.

The components in the turbine section include rotating blade rows and intermediate static stator vane rows. The static stator vanes must be mounted within the housing. Mount flanges have been utilized that have generally extended in a circumferential direction relative to an axis of rotation of the engine.

One approach to providing turbine components that can survive very high temperatures is to form them of CMCs. Typically a CMC component is formed of a plurality of plies that are laid up to make the overall component. There are challenges with CMC components.

SUMMARY OF THE INVENTION

In a featured embodiment, a stator vane for use in a gas turbine engine includes a body formed of ceramic matrix composites ("CMC"). The body has an airfoil with a pressure side and a suction side and extends from a leading edge to a trailing edge. There is a radially outer platform and a radially inner platform attached to the airfoil. Each of the radially inner and radially outer platforms have a pair of flanges on a side of each of the radially inner platform and radially outer platform which is remote from the airfoil. One of each the pair of flanges extend along each of the radially inner platform and the radially outer platform. One of each the pair of flanges at each of the radially inner platform and at the radially outer platform have a first of the pair of flanges associated with the suction side of the airfoil and a second of the pair of flanges associated with the pressure side of the airfoil. The flanges extend in a generally axial direction. The first of the pair of flanges extend over at least a majority of the suction side measured between the leading and trailing edge of the airfoil and the second of the pair of flanges extend over at least a majority of the pressure side measured between the leading and trailing edges of the airfoil.

In another embodiment according to the previous embodiment, a footprint of the airfoil extends through each of the radially inner platform and the radially outer platform has an overlap area with one of the flanges at each of the radially inner platform and the radially outer platform.

In another embodiment according to any of the previous embodiments, the overlap is with the first of the pair of flanges.

In another embodiment according to any of the previous embodiments, the airfoil is positioned closer to one of the flanges on each of the radially inner platform and the radially outer platform.

In another embodiment according to any of the previous embodiments, there are a plurality of stator vanes with adjacent ones of the stator vanes having one of the pair of flanges associated with each of the inner and outer platforms secured adjacent to each other through a clip.

In another embodiment according to any of the previous embodiments, a t-seal is positioned adjacent the flanges secured together by the clip, with the t-seal having an intermediate finger fitting between the flanges, and the clip being positioned outwardly of each of the t-seals.

In another embodiment according to any of the previous embodiments, a surface of each of the flanges is formed at an angle, such that surface extends from an edge radially closer to each of the platform with a component extending in a direction back across the associated platform such that the two adjacent flanges being secured to have outwardly extending angled surfaces, and the clip having a mating angled inner surface on the ears.

In another embodiment according to any of the previous embodiments, a surface of each of the flanges is formed at an angle, such that surface extends from an edge radially closer to each of the platform with a component extending in a direction back across the associated platform such that the two adjacent flanges being secured to have outwardly extending angled surfaces, and the clip having a mating angled inner surface on the ears.

In another embodiment according to any of the previous embodiments, the stator vane is formed of a plurality of CMC plies layered together to form the airfoil, the radially inner platform and the radially outer platform, and the pair of flanges at each of the radially inner platform and the radially outer platform.

In another embodiment according to any of the previous embodiments, at least one of the plurality of layers includes a layer extending from one of the flanges at the radially inner platform along a surface of the airfoil, and to one of the flanges at the radially outer platform.

In another embodiment according to any of the previous embodiments, at least one of the layers includes a layer forming a portion of each of the pair of flanges at each of the radially inner platform and the radially outer platform.

In another embodiment according to any of the previous embodiments, the plurality of layers include layers forming an outer surface of one of the pair of flanges at the radially outer platform, extending along a surface of the airfoil, and to an outer surface of one of the pair of flanges at the radially inner platform.

In another featured embodiment, a gas turbine engine includes a compressor section, a combustor and a turbine section. The turbine section has rotating turbine blades and stator vanes intermediate rows of the rotating turbine blades. The stator vanes includes a body formed of ceramic matrix composites ("CMC"). The body has an airfoil with a pressure side and a suction side and extends from a leading edge to a trailing edge. There is a radially outer platform and a radially inner platform attached to the airfoil. Each of the radially inner and radially outer platforms have a pair of flanges on a side of each of the radially inner platform and radially outer platform which is remote from the airfoil. One of each the pair of flanges extend along each of the radially inner platform and the radially outer platform. One of each the pair of flanges at each of the radially inner platform and at the radially outer platform have a first of the pair of flanges associated with the suction side of the airfoil and a second of the pair of flanges associated with the pressure side of the airfoil. The flanges extend in a generally axial direction. The first of the pair of flanges extend over at least a majority of the suction side measured between the leading and trailing edge of the airfoil and the second of the pair of flanges extending over at least a majority of the pressure side measured between the leading and trailing edges of the airfoil.

In another embodiment according to any of the previous embodiments, a footprint of the airfoil extended through each of the radially inner platform and the radially outer platform has an overlap area with one of the flanges at each of the radially inner platform and the radially outer platform.

In another embodiment according to any of the previous embodiments, the overlap is with the first of the pair of flanges.

In another embodiment according to any of the previous embodiments, there are a plurality of stator vanes with adjacent ones of the stator vanes having one of the pair of flanges associated with each of the inner and outer platforms secured adjacent to each other through a clip.

In another embodiment according to any of the previous embodiments, a t-seal is positioned adjacent the flanges secured together by the clip, with the t-seal having an intermediate finger fitting between the flanges, and the clip being positioned outwardly of each of the t-seals.

In another embodiment according to any of the previous embodiments, a surface of each of the flanges is formed at an angle, such that surface extends from an edge radially closer to each of the platform with a component extending in a direction back across the associated platform such that the two adjacent flanges being secured to have outwardly extending angled surfaces, and the clip having a mating angled inner surface on the ears.

In another embodiment according to any of the previous embodiments, a surface of each of the flanges is formed at an angle, such that surface extends from an edge radially closer to each of the platform with a component extending in a direction back across the associated platform such that the two adjacent flanges being secured to have outwardly extending angled surfaces, and the clip having a mating angled inner surface on the ears.

In another embodiment according to any of the previous embodiments, the stator vane is formed of a plurality of CMC plies layered together to form the airfoil, the radially inner platform and the radially outer platform, and the pair of flanges at each of the radially inner platform and the radially outer platform.

The present disclosure may include any one or more of the individual features disclosed above and/or below alone or in any combination thereof.

These and other features of the present invention can be best understood from the following specification and drawings, the following of which is a brief description.

DETAILED DESCRIPTION

Figure 1:
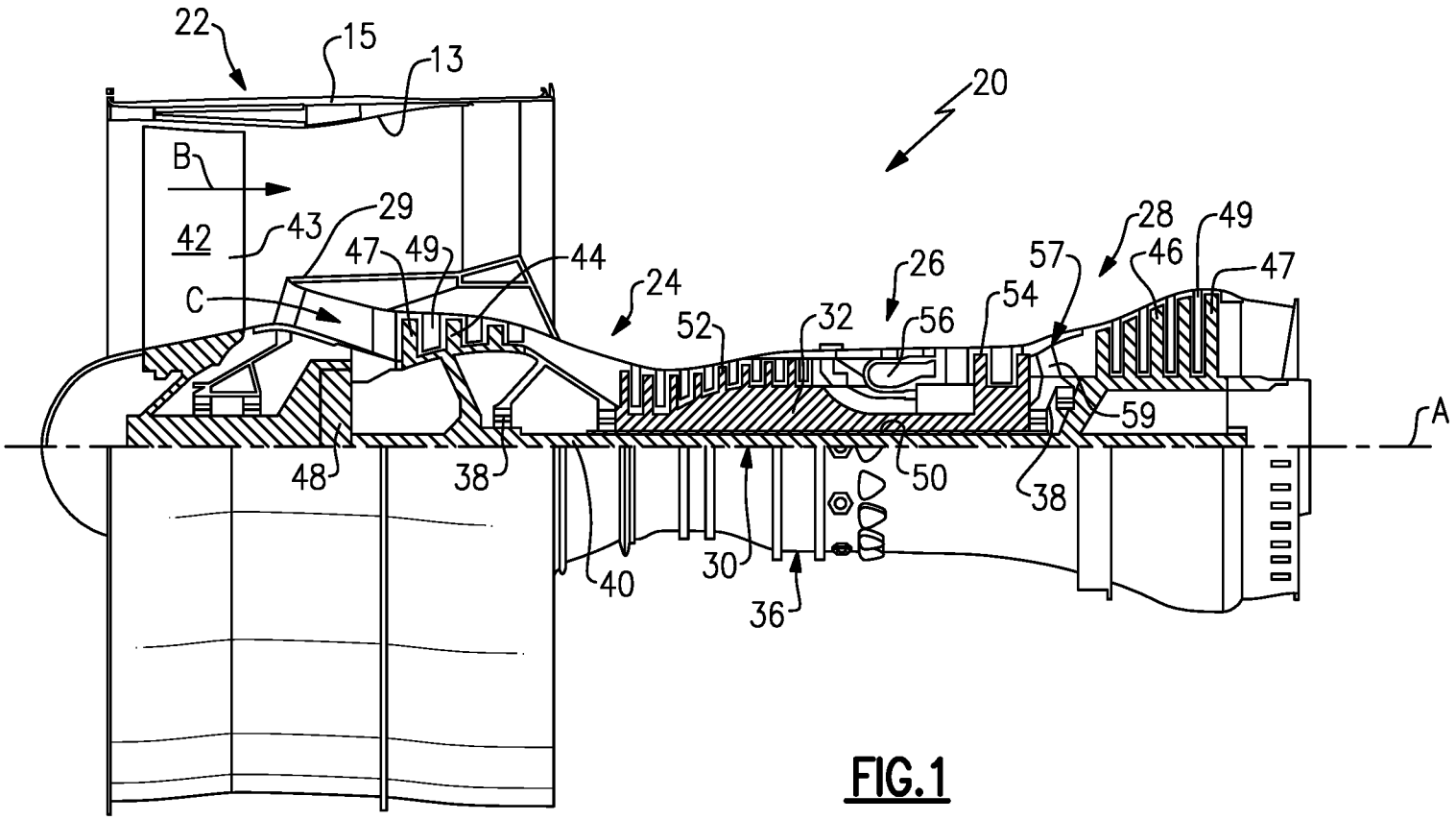
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26, and a turbine section 28. The fan section 22 may include a single-stage fan 42 having a plurality of fan blades 43. The fan blades 43 may have a fixed stagger angle or may have a variable pitch to direct incoming airflow from an engine inlet. The fan 42 drives air along a bypass flow path B in a bypass duct 13 defined within a housing 15 such as a fan case or nacelle, and also drives air along a core flow path C for compression and communication into the combustor section 26 then expansion through the turbine section 28. A splitter 29 aft of the fan 42 divides the air between the bypass flow path B and the core flow path C. The housing 15 may surround the fan 42 to establish an outer diameter of the bypass duct 13. The splitter 29 may establish an inner diameter of the bypass duct 13. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures. The engine 20 may incorporate a variable area nozzle for varying an exit area of the bypass flow path B and/or a thrust reverser for generating reverse thrust.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in the exemplary gas turbine engine 20 is illustrated as a geared architecture 48 to drive the fan 42 at a lower speed than the low speed spool 30. The inner shaft 40 may interconnect the low pressure compressor 44 and low pressure turbine 46 such that the low pressure compressor 44 and low pressure turbine 46 are rotatable at a common speed and in a common direction. In other embodiments, the low pressure turbine 46 drives both the fan 42 and low pressure compressor 44 through the geared architecture 48 such that the fan 42 and low pressure compressor 44 are rotatable at a common speed. Although this application discloses geared architecture 48, its teaching may benefit direct drive engines having no geared architecture. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

Airflow in the core flow path C is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core flow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The low pressure compressor 44, high pressure compressor 52, high pressure turbine 54 and low pressure turbine 46 each include one or more stages having a row of rotatable airfoils. Each stage may include a row of vanes adjacent the rotatable airfoils. The rotatable airfoils are schematically indicated at 47, and the vanes are schematically indicated at 49.

The engine 20 may be a high-bypass geared aircraft engine. The bypass ratio can be greater than or equal to 10.0 and less than or equal to about 18.0, or more narrowly can be less than or equal to 16.0. The geared architecture 48 may be an epicyclic gear train, such as a planetary gear system or a star gear system. The epicyclic gear train may include a sun gear, a ring gear, a plurality of intermediate gears meshing with the sun gear and ring gear, and a carrier that supports the intermediate gears. The sun gear may provide an input to the gear train. The ring gear (e.g., star gear system) or carrier (e.g., planetary gear system) may provide an output of the gear train to drive the fan 42. A gear reduction ratio may be greater than or equal to 2.3, or more narrowly greater than or equal to 3.0, and in some embodiments the gear reduction ratio is greater than or equal to 3.4. The gear reduction ratio may be less than or equal to 4.0. The fan diameter is significantly larger than that of the low pressure compressor 44. The low pressure turbine 46 can have a pressure ratio that is greater than or equal to 8.0 and in some embodiments is greater than or equal to 10.0. The low pressure turbine pressure ratio can be less than or equal to 13.0, or more narrowly less than or equal to 12.0. Low pressure turbine 46 pressure ratio is pressure measured prior to an inlet of low pressure turbine 46 as related to the pressure at the outlet of the low pressure turbine 46 prior to an exhaust nozzle. It should be understood, however, that the above parameters are only exemplary of one embodiment of a geared architecture engine and that the present invention is applicable to other gas turbine engines including direct drive turbofans. All of these parameters are measured at the cruise condition described below.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above, and those in the next paragraph are measured at this condition unless otherwise specified.

"Fan pressure ratio" is the pressure ratio across the fan blade 43 alone, without a Fan Exit Guide Vane ("FEGV") system. A distance is established in a radial direction between the inner and outer diameters of the bypass duct 13 at an axial position corresponding to a leading edge of the splitter 29 relative to the engine central longitudinal axis A. The fan pressure ratio is a spanwise average of the pressure ratios measured across the fan blade 43 alone over radial positions corresponding to the distance. The fan pressure ratio can be less than or equal to 1.45, or more narrowly greater than or equal to 1.25, such as between 1.30 and 1.40. "Corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The corrected fan tip speed can be less than or equal to 1150.0 ft/second (350.5 meters/second), and can be greater than or equal to 1000.0 ft/second (304.8 meters/second).

Figure 2A:
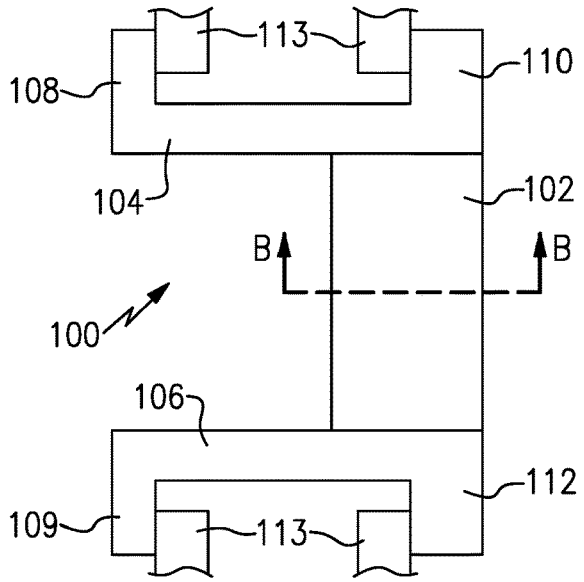
FIG. 2A shows a stator vane.

As is known, there are rows or rotating turbine blades with intermediate rows of stator vanes. A stator vane 100 according to this disclosure is illustrated in FIG. 2A. Stator vane 100 is formed of ceramic matrix composites ("CMC"). Typically, a plurality of layers or plies of CMCs are used to form stator vane 100.

An airfoil 102 extends between a radially outer platform 104 and a radially inner platform 106. According to this disclosure, the radially outer platform 104 has end flanges 108 and 110 which are shown schematically being mounted to static housing structure 113. The housing structure may be bolted to the flanges 108 and 110, or might be otherwise attached. It should be understood the housing structure 113 is shown quite schematically.

Similarly, the radially inner platform 106 has flanges 109 and 112 attached to mount structure 113.

Figure 2B:
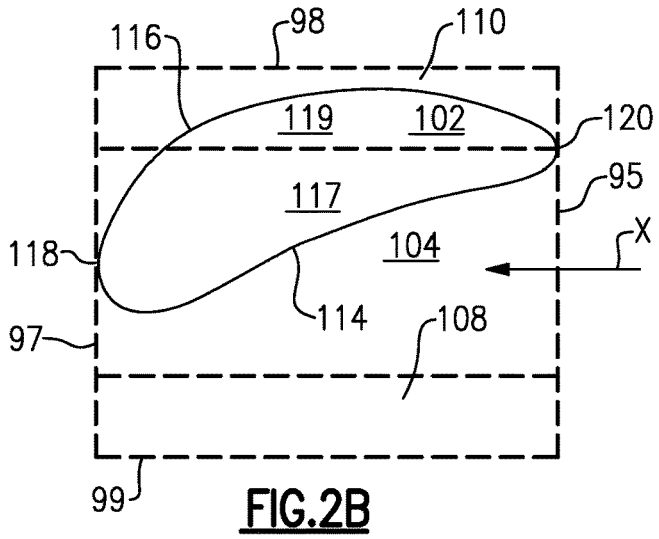
FIG. 2B is a cross-sectional view along line B-B of FIG. 2A.

As mentioned above, in the prior art mount flanges have typically extended along a circumferential direction relative to an axis of rotation of the gas turbine engine. As shown in FIG. 2B, the axis of rotation is X. The flanges 108 and 110 are shown here extending generally axially and parallel to the axis of rotation X. As can be appreciated, the airfoil 102 has a pressure face 114 and a suction face 116. The airfoil 102 extends from a leading edge 118 to a trailing edge 120. The platform 104 has a suction side wall 98, pressure side wall 99, leading edge wall 97 and trailing edge wall 95.

The flange 110 is shown associated with the suction side 116 of airfoil 102, and suction side 98 of the platform 104. As can be seen, if the airfoil 102 were extended upwardly through the radially outer platform 104 the airfoils footprint 117 includes some overlap 119 with a footprint of the flange 110. This provides additional strength to the airfoil and the overall stator vane 100. While platform 104 is shown, a similar overlap is found at platform 106.

Depending on design goals, the overlap can be formed on the pressure side 114.

As can be seen in this figure, flanges 108 and 110 extend along the majority of the axial length of sides 114 and 116 of the airfoil 102 and along the majority of the axial length of the sides 99 and 98 of platform 104. The same is true with flanges 109 and 112 on platform 106.

Figure 3:
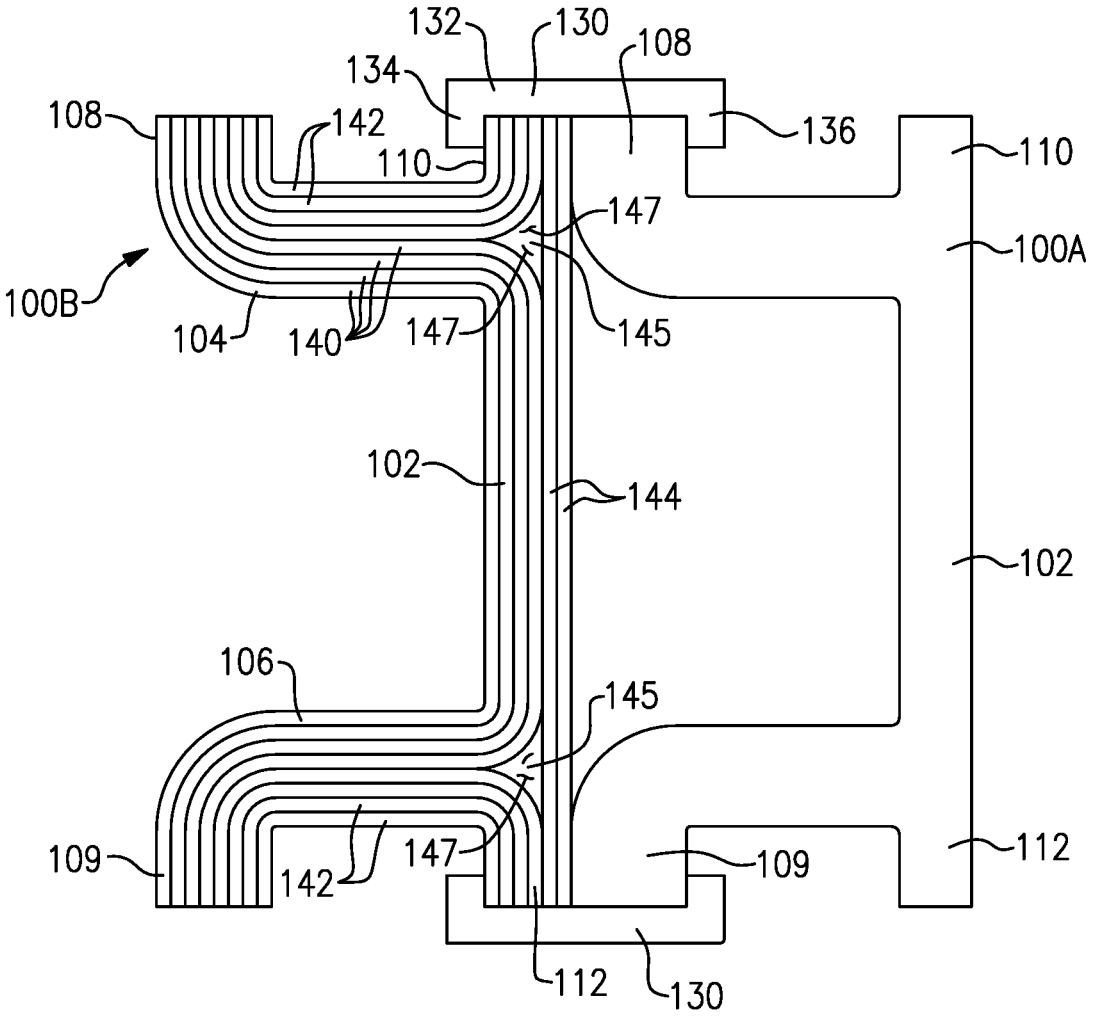
FIG. 3 shows further detail of the formation and mounting of the stator vane according to this disclosure.

FIG. 3 shows two of the stator vanes 100A and 100B that are attached together. As can be seen, a flange 108 of the stator vane 100A is positioned adjacent a flange 110 of the stator vane 100B. Similarly, the flange 112 of the stator vane 100B and the flange 109 of the stator vane 100A are secured together.

It should be understood, additional stator vanes are attached to the opposed side of stator vanes 100A and 100B.

A c-clip 130 snaps over the flanges to secure the two stator vanes 100A and 100B together and to provide a seal. The c-clip 130 has a central web 132 and end ears 134 and 136 which are positioned outwardly of the flanges 110, 108, 112 and 109.

The c-clip could be formed of a CMC material or a metal. It could also be formed of a flexible material to aid in assembly. If the c-clip is formed of a CMC material, it will withstand very high temperatures. In addition, there would not be a difference in the coefficient of thermal expansion between the c-clip 130 and the stator vanes 100A and 100B if CMCs are used to form both.

Providing the securing and sealing structure at this radially outer location removes all such component from a flow path defined radially intermediate the radially outer platform 104 and radially inner platform 106 and the airfoil 102. This provides benefits in reducing flow obstruction.

FIG. 3 also schematically shows an example of how the ply layup of the CMC layers could be achieved. As shown, there are a plurality of ply layers 140 beginning in flange 108, extending through the outer platform 104, along an outer surface of the airfoil 102, back along the inner platform 106 and back to the flange 109.

Further, there are layers 142 that extend between one flange 109 along an inner surface of each of the platforms, and to the opposed flange 112. The layers 142 will resist delamination during operation of the component. The same is true of layers 142 between flanges 108 and 110.

Finally, there are layers 144 that extend along one side of the airfoil, and extend from the inner flange 112 entirely to the outer flange 110. These layers in particular will provide additional strength to the stator vane 100.

In addition, hollows 145 may be filled with noodles, which are typically loose fibers 147 (shown schematically) which are then densified when the ply layers are all densified. It is known that the layers are put together, and then a matrix is injected to densify the overall component. At that time, the fibers in the noodle will also become densified. Alternatively, the fibers 147 (also known as noodle) may be predensified such that the shape of the noodle can be controlled for the particular space.

Figure 4:
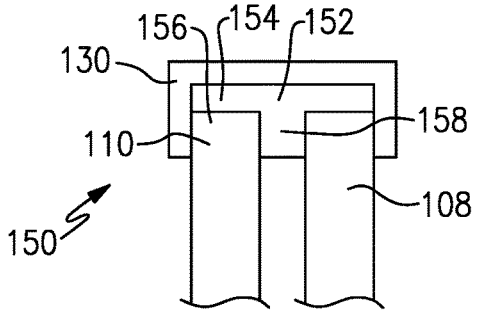
FIG. 4 shows an alternative embodiment, which includes a seal.

FIG. 4 shows a further optional feature 150. Here, a t-seal 152 has a central finger 158 that is positioned between the flanges 108 and 110, and an outer web 154 which sits outwardly of a radial tip 156 of the flanges 108 and 110. A c-clip 130 is shown fitting outwardly of the t-seal. The t-seal 152 may be made of known seal material which has some high temperature capability. The same arrangement can be used at the opposed radial location. The t-seal reduces leakage from the flow path.

Figure 5:
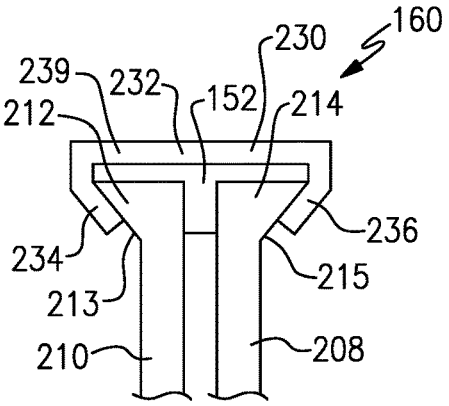
FIG. 5 shows an alternative embodiment for securing two vanes.

FIG. 5 shows yet another embodiment 160. Here again, a t-seal 152 is illustrated between flanges 208 and 210. However, this embodiment could be utilized without such a t-seal. The c-clip 230 has a central web 232 and end ears 234 and 236. As shown, the flanges 208 and 210 have radial ends 212 and 214 which have an angled portion that extends in a direction away from the opposed flange. Stated otherwise, the end portions 212 and 214 have an angled outer face which extends in a direction with a circumferential component over the platform to which they are associated. The end ears 234 and 236 are also angled in a complimentary direction such that the c-clip 230 tends to hold two flanges tightly together.

A stator vane for use in a gas turbine engine under this disclosure could be said to include a body formed of ceramic matrix composites ("CMC"). The body has an airfoil with a pressure side and a suction side and extending from a leading edge to a trailing edge. There is a radially outer platform and a radially inner platform attached to the airfoil. Each of the radially inner and radially outer platforms have a pair of flanges on a side of each of the radially inner platform and radially outer platform which is remote from the airfoil.

One of each of the pair of flanges extend along each of the radially inner platform and the radially outer platform. One of each of the pair of flanges at each of the radially inner platform and at the radially outer platform have a first of the pair of flanges associated with the suction side of the airfoil and a second of the pair of flanges associated with the pressure side of the airfoil. The flanges extend in a generally axial direction, and with the first of the pair of flanges extending over at least a majority of the suction side measured between the leading and trailing edge of the airfoil. The second of the pair of flanges extending over at least a majority of the pressure side measured between the leading and trailing edges of the airfoil.

Although embodiments have been disclosed, a worker of ordinary skill in this art would recognize that modifications would come within the scope of this disclosure. For that reason, the following claims should be studied to determine the true scope and content of this disclosure.

What is claimed is:

1. A stator vane assembly for use in a gas turbine engine comprising:

a body formed of ceramic matrix composites ("CMC"), said body having an airfoil with a pressure side and a suction side and extending from a leading edge to a trailing edge;

there being a radially outer platform and a radially inner platform attached to said airfoil;

each of said radially inner and radially outer platforms having a pair of flanges on a side of each of said radially inner platform and radially outer platform which is remote from said airfoil, with one of each said pair of flanges extending along each of said radially inner platform and said radially outer platform, and one of each said pair of flanges at each of the radially inner platform and at the radially outer platform have a first of the pair of flanges associated with the suction side of said airfoil and a second of said pair of flanges associated with the pressure side of said airfoil;

said flanges extending in a generally axial direction, and with said first of said pair of flanges extending over at least a majority of the suction side measured between the leading and trailing edge of said airfoil and the second of said pair of flanges extending over at least a majority of the pressure side measured between the leading and trailing edges of the airfoil; and wherein there are a plurality of stator vanes with adjacent ones of said stator vanes having one of said pair of flanges associated with each of said inner and outer platforms secured adjacent to each other through a clip.

2. The stator vane assembly as set forth in claim 1, wherein a footprint of the airfoil extended through each of the radially inner platform and the radially outer platform has an overlap area with one of said flanges at each of said radially inner platform and the radially outer platform.

3. The stator vane assembly as set forth in claim 2, wherein the overlap is with the first of said pair of flanges.

4. The stator vane assembly as set forth in claim 2, wherein said airfoil is positioned closer to one of said flanges on each of said radially inner platform and the radially outer platform.

5. The stator vane assembly as set forth in claim 1, wherein a t-seal is positioned adjacent the flanges secured together by the clip, with said t-seal having an intermediate finger fitting between said flanges, and said clip being positioned outwardly of each of said t-seals.

6. The stator vane assembly as set forth in claim 5, wherein a surface of each of said flanges is formed at an angle, such that surface extends from an edge radially closer to each of said platform with a component extending in a direction back across the associated platform such that the two adjacent flanges being secured to have outwardly extending angled surfaces, and said clip having a mating angled inner surface on said ears.

7. The stator vane assembly as set forth in claim 5, wherein a surface of each of said flanges is formed at an angle, such that surface extends from an edge radially closer to each of said platform with a component extending in a direction back across the associated platform such that the two adjacent flanges being secured to have outwardly extending angled surfaces, and said clip having a mating angled inner surface on said ears.

8. The stator vane assembly as set forth in claim 1, wherein said stator vane is formed of a plurality of CMC plies layered together to form the airfoil, the radially inner platform and the radially outer platform, and the pair of flanges at each of the radially inner platform and the radially outer platform.

9. The stator vane assembly as set forth in claim 8, wherein at least one of said plurality of layers includes a layer extending from one of the flanges at said radially inner platform along a surface of said airfoil, and to one of the flanges at said radially outer platform.

10. The stator vane assembly as set forth in claim 9, wherein at least one of said layers includes a layer forming a portion of each of said pair of flanges at each of the radially inner platform and the radially outer platform.

11. The stator vane assembly as set forth in claim 10, wherein said plurality of layers include layers forming an outer surface of one of the pair of flanges at said radially outer platform, extending along a surface of said airfoil, and to an outer surface of one of the pair of flanges at said radially inner platform.

12. A gas turbine engine comprising:

a compressor section, a combustor and a turbine section, said turbine section having rotating turbine blades and stator vanes intermediate rows of said rotating turbine blades, said stator vanes including:

a body formed of ceramic matrix composites ("CMC"), said body having an airfoil with a pressure side and a suction side and extending from a leading edge to a trailing edge;

there being a radially outer platform and a radially inner platform attached to said airfoil;

each of said radially inner and radially outer platforms having a pair of flanges on a side of each of said radially inner platform and radially outer platform which is remote from said airfoil, with one of each said pair of flanges extending along each of said radially inner platform and said radially outer platform, and one of each said pair of flanges at each of the radially inner platform and at the radially outer platform having a first of the pair of flanges associated with the suction side of said airfoil and a second of said pair of flanges associated with the pressure side of said airfoil;

said flanges extending in a generally axial direction, and with said first of said pair of flanges extending over at least a majority of the suction side measured between the leading and trailing edge of said airfoil and the second of said pair of flanges extending over at least a majority of the pressure side measured between the leading and trailing edges of the airfoil; and said each of said pair of flanges associated with each of said radially inner and radially outer platforms being secured to static housing structure.

13. The gas turbine engine as set forth in claim 12, wherein a footprint of the airfoil extended through each of the radially inner platform and the radially outer platform has an overlap area with one of said flanges at each of the radially inner platform and the radially outer platform.

14. The gas turbine engine as set forth in claim 13, wherein the overlap is with the first of said pair of flanges.

15. A gas turbine engine comprising:

a compressor section, a combustor and a turbine section, said turbine section having rotating turbine blades and stator vanes intermediate rows of said rotating turbine blades, said stator vanes including:

a body formed of ceramic matrix composites ("CMC"), said body having an airfoil with a pressure side and a suction side and extending from a leading edge to a trailing edge;

there being a radially outer platform and a radially inner platform attached to said airfoil;

each of said radially inner and radially outer platforms having a pair of flanges on a side of each of said radially inner platform and radially outer platform which is remote from said airfoil, with one of each said pair of flanges extending along each of said radially inner platform and said radially outer platform, and one of each said pair of flanges at each of the radially inner platform and at the radially outer platform having a first of the pair of flanges associated with the suction side of said airfoil and a second of said pair of flanges associated with the pressure side of said airfoil;

said flanges extending in a generally axial direction, and with said first of said pair of flanges extending over at least a majority of the suction side measured between the leading and trailing edge of said airfoil and the second of said pair of flanges extending over at least a majority of the pressure side measured between the leading and trailing edges of the airfoil; and wherein there are a plurality of stator vanes with adjacent ones of said stator vanes having one of said pair of flanges associated with each of said inner and outer platforms secured adjacent to each other through a clip.

16. The gas turbine engine as set forth in claim 15, wherein a t-seal is positioned adjacent the flanges secured together by the clip, with said t-seal having an intermediate finger fitting between said flanges, and said clip being positioned outwardly of each of said t-seals.

17. The gas turbine engine as set forth in claim 16, wherein a surface of each of said flanges is formed at an angle, such that surface extends from an edge radially closer to each of said platform with a component extending in a direction back across the associated platform such that the two adjacent flanges being secured to have outwardly extending angled surfaces, and said clip having a mating angled inner surface on said ears.

18. The gas turbine engine as set forth in claim 15, wherein a surface of each of said flanges is formed at an angle, such that surface extends from an edge radially closer to each of said platform with a component extending in a direction back across the associated platform such that the two adjacent flanges being secured to have outwardly extending angled surfaces, and said clip having a mating angled inner surface on said ears.

19. The gas turbine engine as set forth in claim 12, wherein said stator vane is formed of a plurality of CMC plies layered together to form the airfoil, the radially inner platform and the radially outer platform, and the pair of flanges at each of the radially inner platform and the radially outer platform.

20. The gas turbine engine as set forth in claim 12, wherein the housing structure is bolted to each of said pair of flanges at each of said radially inner and radially outer platforms.

* * * * *